United States Patent [19]

Peterson

[11] 3,975,077

[45] Aug. 17, 1976

[54] ELECTRICAL CONNECTOR

[75] Inventor: Dean M. Peterson, Littleton, Colo.

[73] Assignee: Honeywell Inc., Minneapolis, Minn.

[22] Filed: May 12, 1975

[21] Appl. No.: 576,638

[52] U.S. Cl. ..... 339/177 R; 339/252 R

[51] Int. Cl.[2] ..... H01R 13/06

[58] Field of Search ..... 339/177, 183, 252

[56] References Cited

UNITED STATES PATENTS

| | | | |
|---|---|---|---|
| 1,170,959 | 2/1916 | Campbell | 339/177 R |
| 3,242,456 | 3/1966 | Duncan | 339/252 R |
| 3,295,097 | 12/1966 | Van Horssen et al. | 339/252 R |
| 3,678,440 | 7/1972 | Gilsdorf | 339/252 P |

*Primary Examiner*—Joseph H. McGlynn
*Attorney, Agent, or Firm*—Henry L. Hanson; C. J. Ungemach; D. R. Fairbairn

[57] ABSTRACT

A sturdy electrical connector of the type used with camera equipment and known in the art as P.C. connectors has the outer end portion of its center pin bent in a prescribed manner to provide good mating electrical contact with an associated socket over long periods of service.

1 Claim, 4 Drawing Figures

ELECTRICAL CONNECTOR

CROSS REFERENCE TO RELATED APPLICATIONS

Subject matter shown and described but not claimed herein is shown, described and claimed in a copending application of Benjamin J. Coler filed on even date herewith.

BACKGROUND OF THE INVENTION

1. Field of the Invention

The present invention relates to an improved electrical connector of the type known as P.C. connectors. The improved connector is particularly useful for providing a good mating contact between small electrical connections such as those used for coupling hand-held cameras to suitable flash devices.

2. Description of the Prior Art

A standard coaxial connector for camera equipment includes a jack, socket or receptacle comprising an inner and an outer sleeve contact coaxially positioned and insulated from each other. A complementary plug for the connector includes an outer cylindrical sleeve and a central pin. Again, the pin is coaxially positioned with respect to and insulated from the sleeve. Such connectors are known in the art as P.C. connectors.

It has been found that, because of the very small dimensions of such connectors, due to wear and strain, or loose tolerances, an unreliable contact is established between the plug pin and the inner sleeve of the jack. Such unreliable contacts often result in a failure of a flash unit to fire when it should, causing a loss of a picture.

In an effort to overcome that deficiency, the pin has heretofore been positioned slightly eccentrically with respect to the outer sleeve of the plug. It has been found that that attempted solution produced a shear strain on the insulator holding the pin in place, resulting in a coldflow of the plastic insulator, again allowing the unreliability element to reappear.

SUMMARY OF THE INVENTION

It is, accordingly, an object of the present invention to provide an improved connector which obviates the noted shortcomings of the known prior art.

It is another object of the present invention to provide an improved connector suitable for use in electrically coupling a camera to a flash unit.

In accomplishing these and other objects, there has been provided, in accordance with the present invention, a connector of the type known in the art as a P.C. connector in which the jack, socket or receptacle is conventional and in which the plug is modified from the conventional in that the central pin is given a predetermined bend or curvature. That bent pin assures that, when the plug is inserted in the conventional jack, a good, reliable electrical contact will be established.

BRIEF DESCRIPTION OF THE DRAWINGS

A better understanding of the present invention may be had when the following detailed description is read in connection with the accompanying drawings in which.

DETAILED DESCRIPTION

Figure 1:
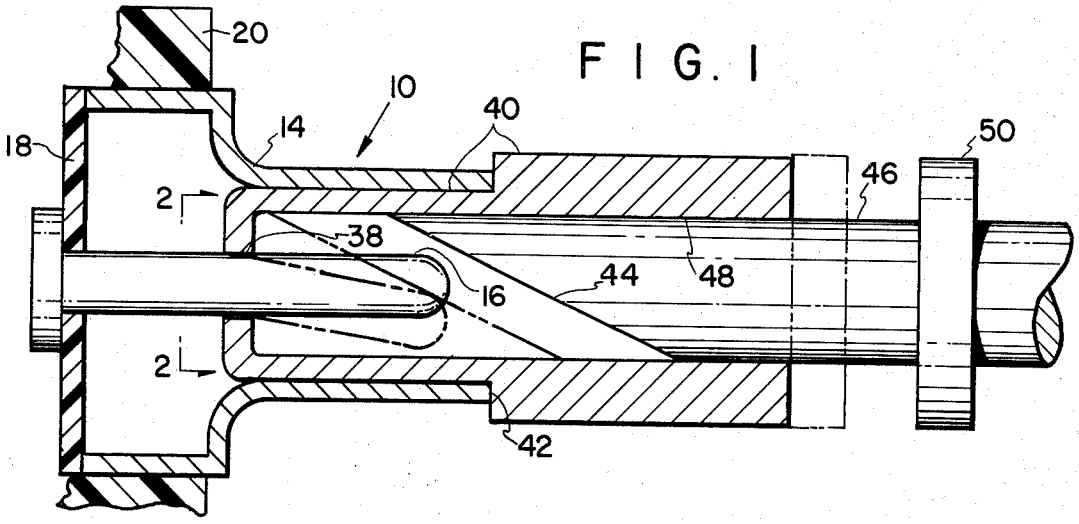
FIG. 1 is an illustration of a P.C. plug embodying the present invention, as well as a jig for effecting the desired result.
Figure 2:
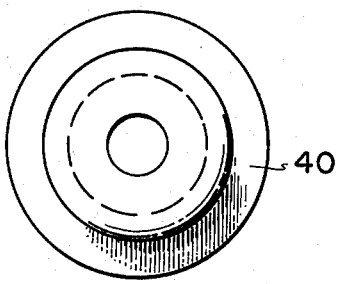
FIG. 2 is an end view of the fixture per se taken along the lines 2—2 of FIG. 1 and viewed in the direction of the arrows.
Figure 3:
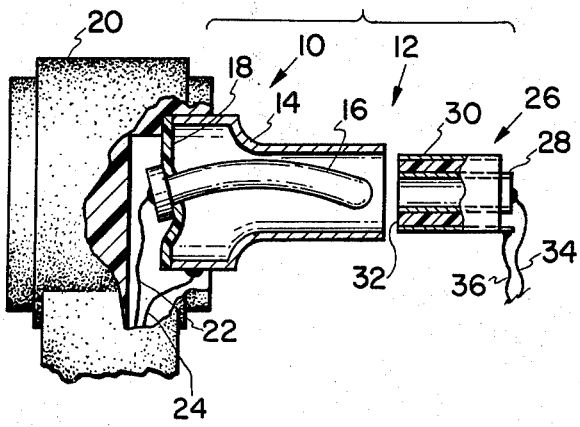
FIG. 3 is a view of the bent center pin and a socket portion of the P.C. jack.
Figure 4:
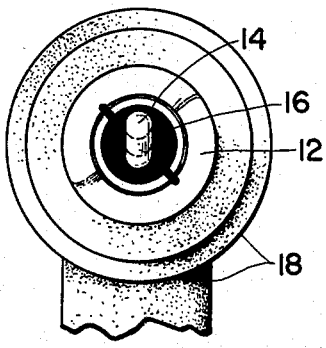
FIG. 4 is an end view of the plug portion of the P.C. connector as shown in FIG. 3.

There is shown in FIG. 1 an enlarged cross-sectional view of a plug portion 10 of a so-called P.C. connector 12 (FIG. 3). The plug includes an outer sleeve conductor 14 and a central pin conductor 16. A base member 18 of insulating material, such as a suitable plastic material, supports the central pin 16 in substantially coaxial relationship with the outer sleeve conductor 14.

The outer sleeve conductor 14 is mounted in a hollow housing 20 that is made of a semi-rigid, plastic insulating material as illustrated in FIG. 3.

The hollow housing 20 is shown broken away to illustrate how associated separate electrical conductors or lead wires 22, 24 are connected to and extend away from the conductive sleeve conductor 14 and from the fixed end of the conductive pin 16.

FIG. 3 also shows a socket 26 having an inner and outer conductive sleeve 28, 30 separated by a ring of insulating material 32. A pair of electrically conductive wires 34, 36 are electrically connected to and extend away from the remote end of each of the sleeves 28, 30. In a conventional arrangement, the socket 26 is mounted in the body of a camera or the like with the open end of the socket slightly recessed below the surface of the camera body, the remote end of the socket being firmly secured within that camera body.

FIG. 1 illustrates the manner in which the center pin 16 of this invention is bent to the position as shown in FIG. 3. The bored out wall 38 of a sleeve-shaped fixture 40 is shown mounted on an outer free end portion of the center pin 16. The shoulder 42 of the fixture 40 is shown in engagement with the right end of the cylindrically shaped cup 14 of the P.C. connector 12.

The tapered end 44 of a cylindrically shaped tool 46, shown in dot dot dash line form, is mounted within the inner cylindrical wall surface 48 of the fixture 40. The tapered end 44 of tool 46 is in physical engagement with the center pin 16 at one end and an opposite stop end portion 50 of the tool 46 is shown in contact with the right end of the fixture 40.

MODE OF OPERATION

The longitudinal centerline of the socket 26 is in alignment with the longitudinal centerline of the center pin 16 before the bending of the pin 16 from its solid to its dot dot dash line position occurs, as is shown in FIG. 1. The bent center pin 16 is then tilted in a counterclockwise direction and the member 18, or base of the cup 14, is crimped into the position shown in FIG. 3 while the fixture 40 is removed from the right end of plug portion 10. The resulting bent tip of the free end of pin 16 will thereby be aligned for engagement with the sleeve 28 as the plug 10 is inserted into the open end of the socket 26.

As the plug 10 is moved from the position shown, for example in FIG. 3, into engagement with the socket 26, the resiliency of the bent center pin 16 will allow it to be deflected slightly and to be brought into good mating electrical contact with the inner surface of sleeve 28. Experimentation has shown that the action of continuously bringing the socket 26 into and out of electrical contact with the bent center pin 16 over long periods of service does not result in the previously-mentioned cold-flow failure of the bent member 18 as has been the case with the previously-mentioned prior art electrical P.C. plug type connectors that have plug and socket connections whose longitudinal axis are axially displaced from one another.

The reason why this contact failure problem is eliminated is because the bent pin 16 and its bent member 18 that is employed in the present invention allows the pin 16 and the bent member 18 to flex without introducing undesired shear stresses in the member which resulted, heretofore, in the cold flow in the member 18.

A sturdy electrical connector 10, known in the art as a P.C. connector, having a characterized bend in an outer free end portion of its center pin 14 thus provides a structure that insures good and reliable electrical mating contact with its associated socket over long periods of service.

In some applications of the present invention, it may be desirable to provide a means of preventing a person from manually disconnecting the socket 26 from its electrically engaged position with the plug portion 10 of the P.C. connector 12 by merely pulling either one of these parts away from the other. This can be accomplished by attaching a first non-conductive part of a coupling to an outer right end peripheral surface portion of the conductive sleeve 30, mounting a remaining non-conductive second part of this coupling in loose captive relationship on an outer right end peripheral portion of the sleeve 14 and providing a threaded connection between these coupling parts.

Connecting these coupling parts to one another by means of this threaded connection will thus prevent the aforementioned socket 26 from being electrically and mechanically inadvertently disconnected from its associated plug portion 10.

When the parts of this threaded connection between the coupling parts are disengaged from one another, the socket 26 can then be electrically and mechanically disconnected from the plug portion 10 by merely pulling one of these latter-mentioned parts away from the other.

The embodiments of the invention in which an exclusive property or privilege is claimed are defined as follows:

1. An electrical conductor comprised of a socket having spaced apart inner and outer electrically conductive sleeves separated from one another by an insulator, a cup-shaped plug having an insulator base, an electrically conductive center pin mounted on and extending away from said base and a conductive sleeve connected at one end to said base and positioned about and in spaced relationship to said pin, and an outer portion of said center pin being bent in a direction toward and in spaced relation to the side wall of said last-mentioned sleeve, and the bent center pin being tilted toward its unbent position causing a crimping of said insulator base and thereby placing the bent center pin in a position aligned for engagement with said inner sleeve of said socket and to provide a good reliable electrical connection with said inner sleeve when said inner sleeve is brought into engagement with said bent portion of said pin.

* * * * *